US006075214A

United States Patent [19]

Sato et al.

[11] Patent Number: 6,075,214

[45] Date of Patent: Jun. 13, 2000

[54] PUSH BUTTON ASSEMBLY FOR A VENDING MACHINE

[75] Inventors: Yoshiaki Sato; Eiichi Nakajima, both of Tokyo, Japan

[73] Assignee: KOHA Co., Ltd., Tokyo, Japan

[21] Appl. No.: 08/992,217

[22] Filed: Dec. 17, 1997

[30] Foreign Application Priority Data

Dec. 24, 1996 [JP] Japan ..... 8-343258

[51] Int. Cl.[7] ..... H01H 9/00; H01H 13/02; H01H 13/70

[52] U.S. Cl. ..... 200/314

[58] Field of Search ..... 200/308–317; 463/26

[56] References Cited

U.S. PATENT DOCUMENTS 5,039,832 8/1991 Polacek et al. ..... 200/317

5,045,656 9/1991 Kojima ..... 200/314

5,072,085 12/1991 Shinohara et al. ..... 200/314

5,134,505 7/1992 Tanaka et al. ..... 359/48

5,547,192 8/1996 Ishibashi ..... 463/26

*Primary Examiner*—J. R. Scott

*Attorney, Agent, or Firm*—Rogers & Killeen

[57] ABSTRACT

A push button for a vending machine. The push button includes a lens that is depressed by the customer. Under the lens is a transparent or semi-transparent flexible cover over a plurality of light emitting diodes (LEDs). The color and arrangement of the LEDs can be varied to provide a number of different indicating modes. The present invention does not require items in conventional push buttons, for example, a letter and symbol plate or a reflector case.

7 Claims, 12 Drawing Sheets

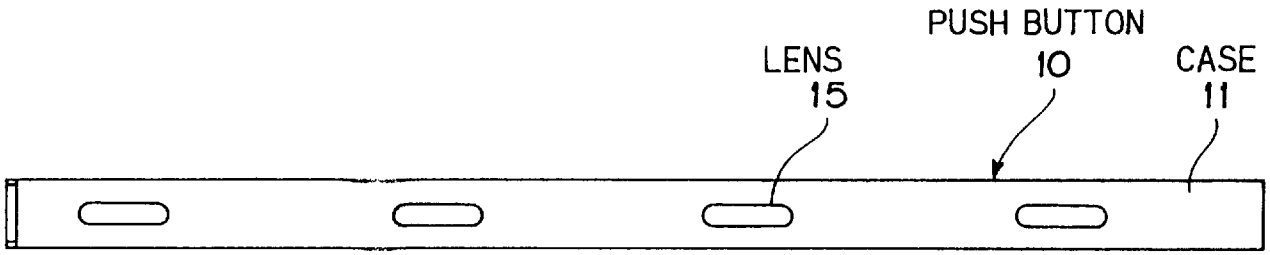
FIG. 9
FIG. 10
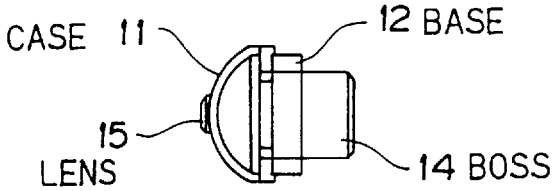

FIG. 13

| INDICATING MODE | EMITTING COLOR AND TURNING STATUS OF LEDs | | INDICATING CONTENT |
|---|---|---|---|
| | GREEN | RED | |
| MODE 1 | SUCCESSSIVE TURNING ON OR FLICKER | TURNING OFF | ON SALE |
| MODE 2 | TURNING OFF | SUCCESSSIVE TURNING ON OR FLICKER | SOLD OUT |

FIG. 14

| INDICATING MODE | EMITTING COLOR AND TURNING STATUS OF LEDs | | INDICATING CONTENT |
|---|---|---|---|
| | GREEN | RED | |
| MODE 1A | SUCCESSSIVE TURNING ON OR FLICKER | SUCCESSSIVE TURNING ON OR FLICKER | ON SALE FOR HOT ARTICLE |
| MODE 1B | SUCCESSSIVE TURNING ON OR FLICKER | TURNING OFF | ON SALE FOR COLD ARTICLE |
| MODE 2 | TURNING OFF | SUCCESSSIVE TURNING ON OR FLICKER | SOLD OUT |

PUSH BUTTON ASSEMBLY FOR A VENDING MACHINE

FIELD OF THE INVENTION

The invention relates to a push button for a vending machine, and more particularly to, a push button which is made small in size and simplified in structure to be used for a vending machine.

BACKGROUND OF THE INVENTION

A conventional vending machine comprises a metal panel in its front, a displaying chamber, having a transparent front panel, which is arranged at an upper portion of the metal panel, and a conventional push button arranged on the transparent front panel.

The conventional push button comprises a case which is made from ASA (Acrylonitrile Styrene Acrylate) resin, a base which is combined with the case to form a frame for containing switch parts, and a flexible cover which is placed in the frame to provide a water-proof space. The case has oval openings for a plurality of lenses to be pushed by a customer and to display predetermined symbol and letters. When one of the lenses is pushed by a finger, a witch for selling an article is turned on.

The base has connectors on its back surface. Each of the connectors is connected to the control unit of the vending machine via a cable. The base is placed on the transparent front panel.

The lens is partially exposed through the oval opening formed in the case. The lens is in contact with a letter and symbol plate on its inside. Light is transmitted through letter and/or symbol portions of the letter and symbol plate, and shielded by the remaining portion of the letter and symbol plate. The flexible cover supports the letter and symbol plate on the opposite side of the lens. A reflector case which includes conical reflectors having apertures at the bottoms is placed on the inside of the flexible cover. The inclined plane of the reflector is processed to have a mirror surface.

A PCB (Printed Circuit Board) on which LEDs (Light Emitting Diodes) to radiate the letter and symbol plate through the acres of the reflectors for indicating "on sale" and "sold out" are mounted is placed on the base. A quantity of light which is supplied to the lens is increased, because the light emitted from the LEDs is reflected by the mirror surface of the reflector. Switching electrodes are also mounted on the PCB. Conductive members are mounted on the inside of the flexible cover to turn on and off the switching electrodes by pushing and releasing the lens.

A boss for fixing the push button on the transparent front panel is provided on the back surface of the base. An aperture into which a screw is inserted is formed in the center of the boss. Ring packings for avoiding water to invade into the displaying chamber are mounted on roots of the boss and the connector.

Each of the lenses is positioned to correspond to each of the article samples. When coins are inserted into the vending machine and there is not an article to be bought in the vending machine by a customer, the LED for indicating "sold out" is controlled to emit light The light from the LED is transmitted through the letter and symbol plate to be passed through the lens. Thus, the customer can know that the article is sold out In the conventional push button for the vending machine, however, there are disadvantages in that its parts is large in number, and costs is high, because the provision of the letter and symbol plate is required to indicate "on sale" or "sold out", the lens can not be made small in width and length, because a predetermined indicating area and the quantity of light are needed for the letters of "sold out" and its size can not be small, because it needs the reflector case.

SUMMARY OF THE INVENTION

Accordingly, it is an object of the invention to provide a push button for a vending machine in which its parts is small in number and costs is low.

It is another object of the invention to provide a push button for a vending machine in which its size is small.

BRIEF DESCRIPTION OF THE DRAWINGS

The invention will be described in more detail in conjunction with the accompanying drawings, wherein:

FIG. 9 is a plan view of the push button of the present invention as shown in FIG. 7;

FIG. 10 is a side view of the push button of the present invention as shown in FIG. 7;

FIG. 13 is a table of a pattern of indicating modes of emitting LEDs; and

FIG. 14 is a table of a pattern of indicating modes of emitting LEDs.

DETAILED DESCRIPTION OF THE PREFERRED EMBODIMENTS

Before explaining a push button for a vending machine in the preferred embodiment according to the invention, the above mentioned conventional push button for a vending machine will be explained in FIGS. 1 to 6.

Figure 1:
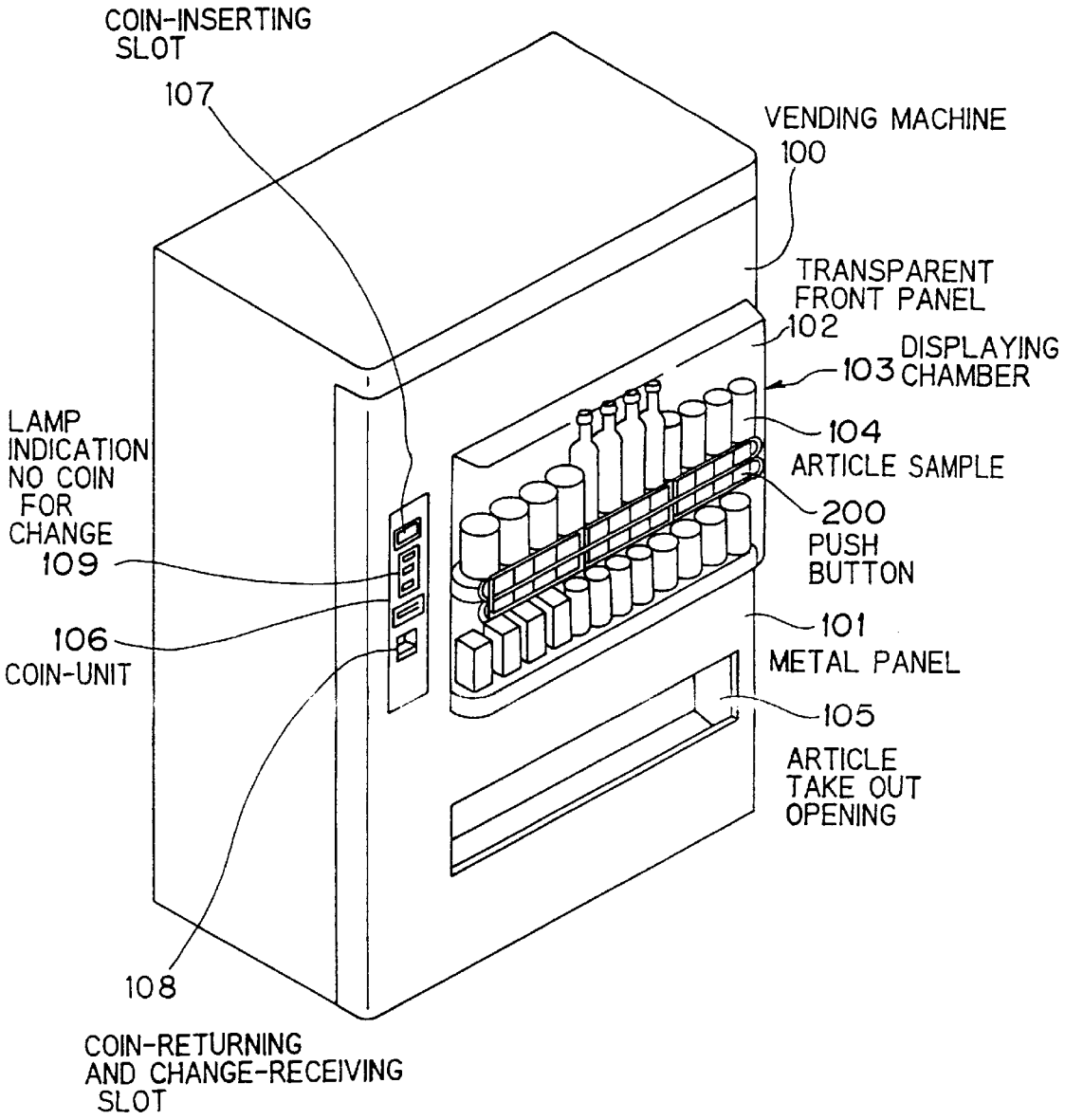
FIG. 1 PRIOR ART
FIG. 1 is a perspective view of a conventional vending machine using a conventional push button.
Figure 2:
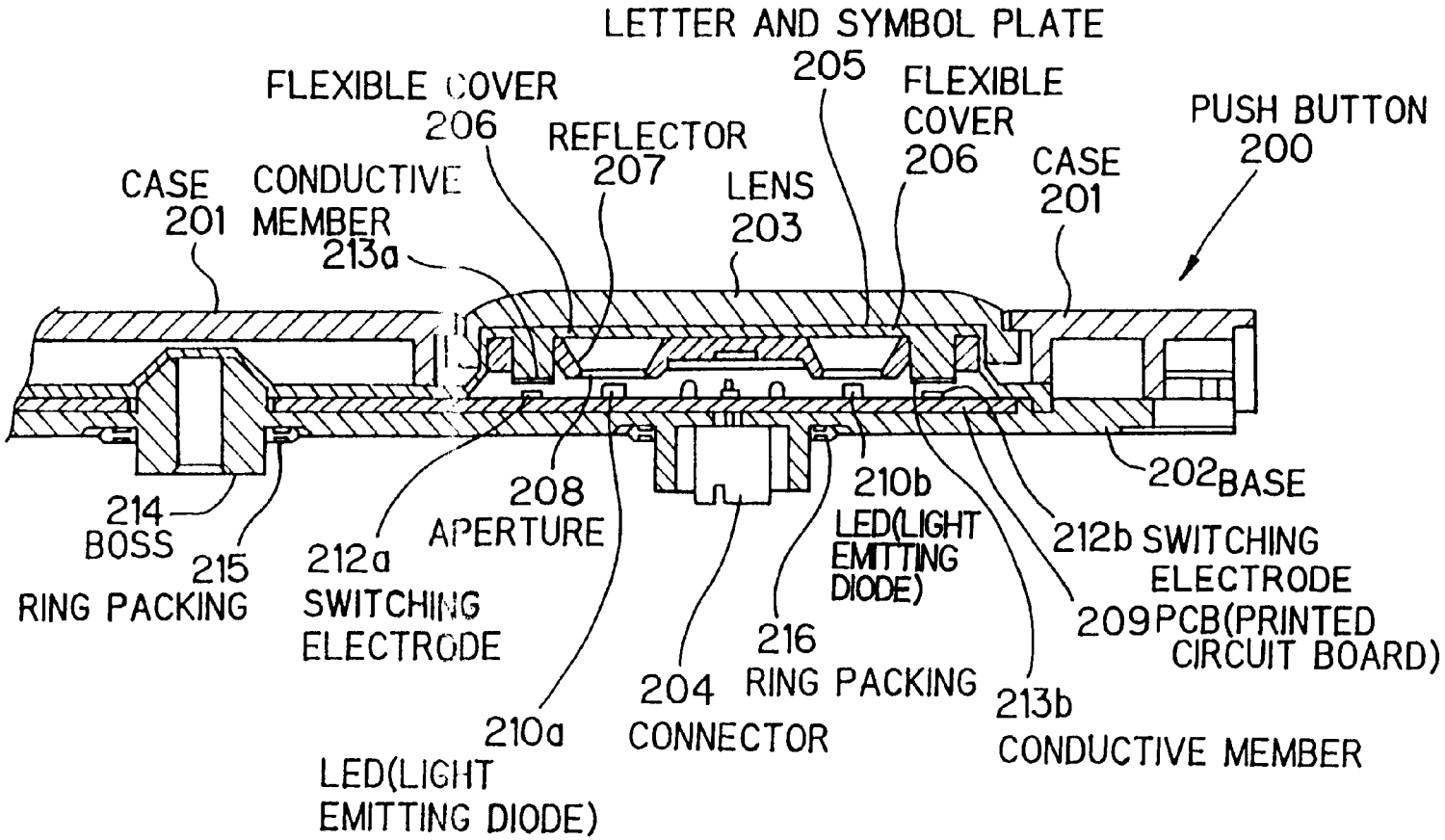
FIG. 2 PRIOR ART
FIG. 2 is a partly diagrammatic sectional view of the conventional push button as shown in FIG. 1.
Figure 3:
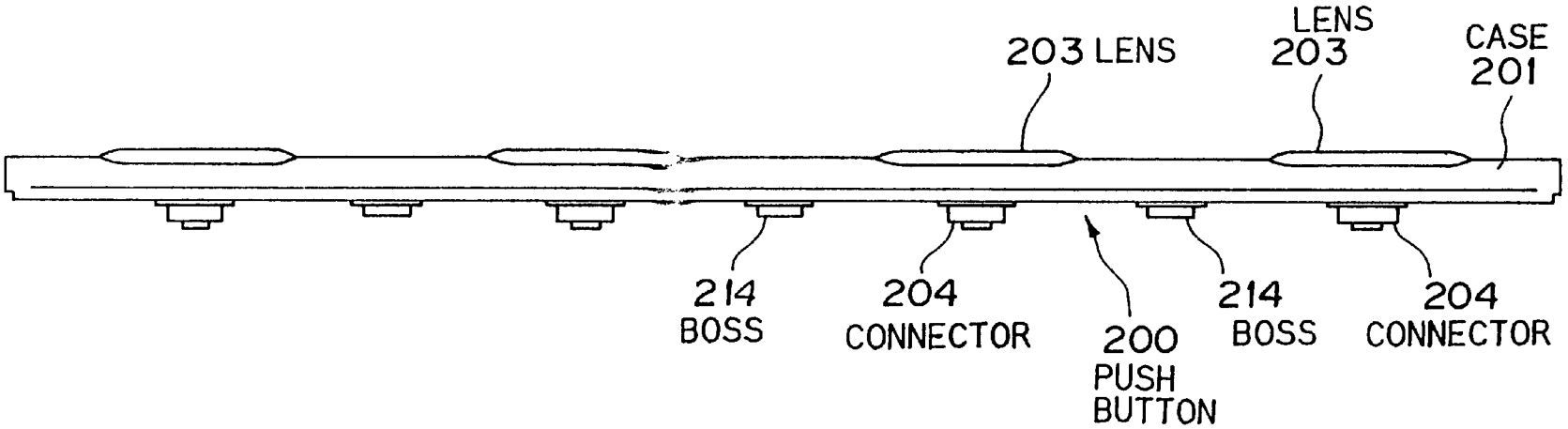
FIG. 3 PRIOR ART
FIG. 3 is a front view of the conventional push button as shown in FIG. 1.
Figure 4:
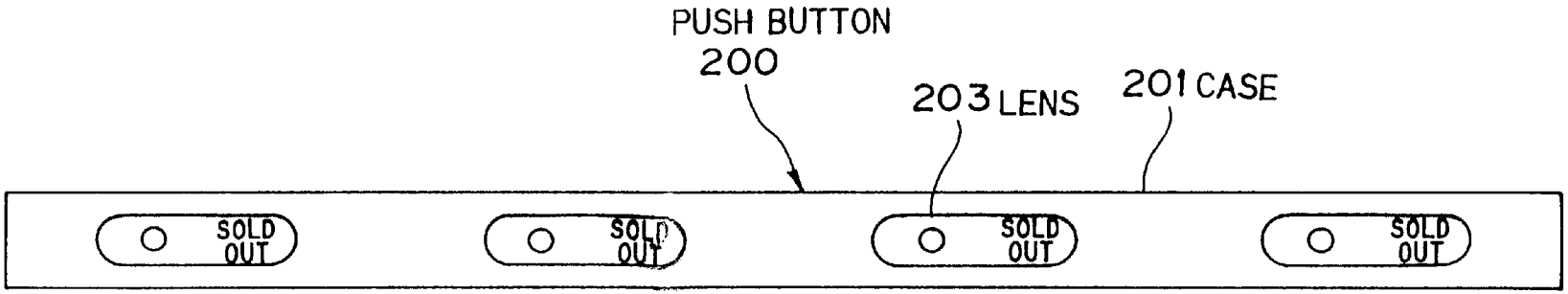
FIG. 4 PRIOR ART
FIG. 4 is a plan view of the conventional push button as shown in FIG. 1.
Figure 5:
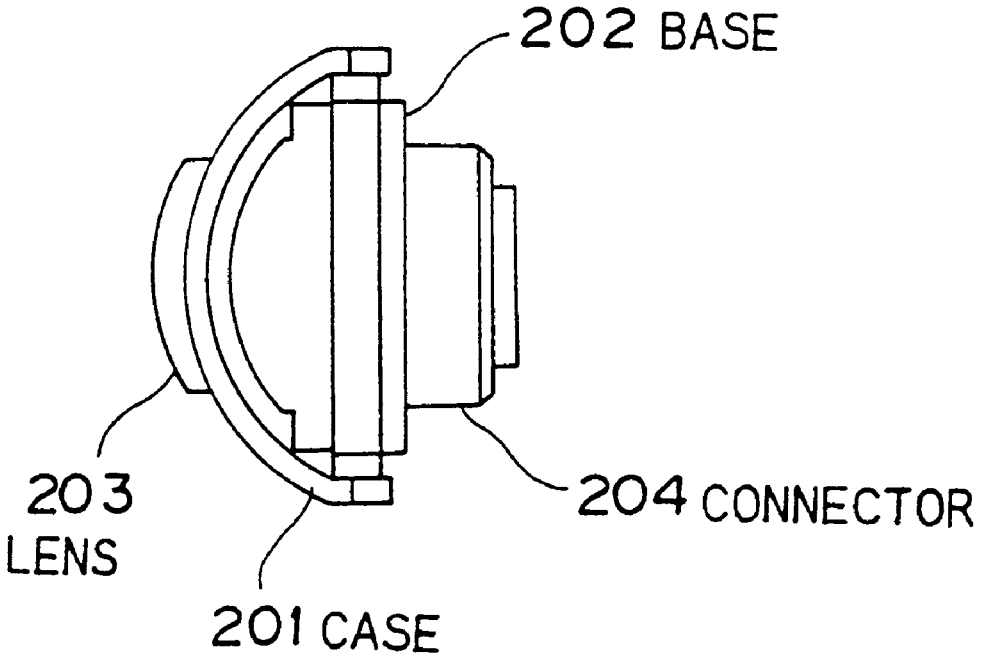
FIG. 5 PRIOR ART
FIG. 5 is a side view of the conventional push button as shown in FIG. 1.
Figure 6:
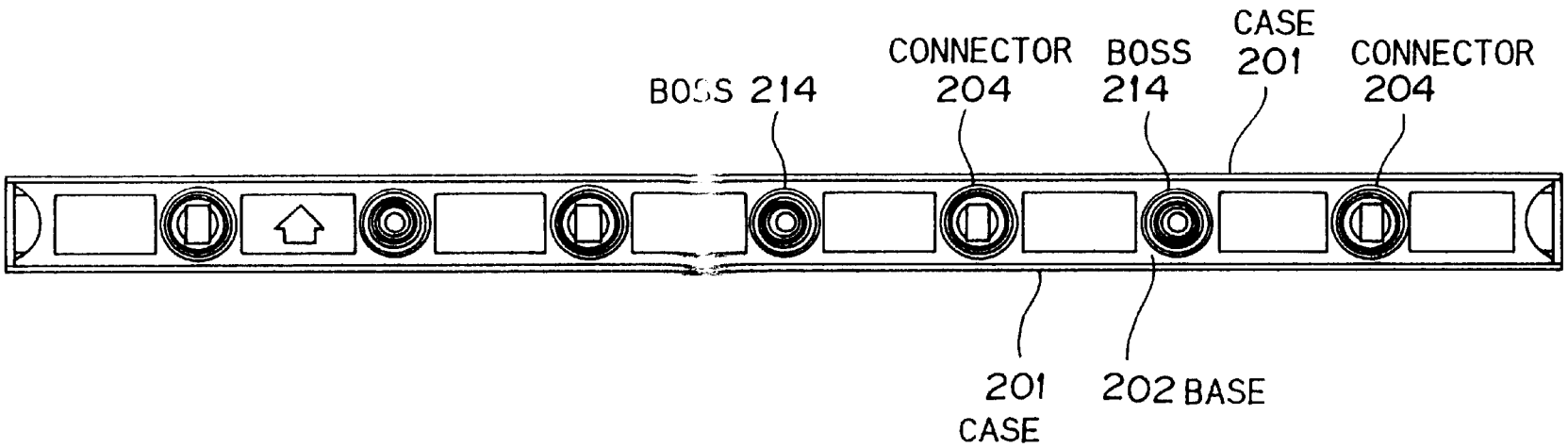
FIG. 6 PRIOR ART
FIG. 6 is a rear view of the conventional push button as shown in FIG. 1.
Figure 7:
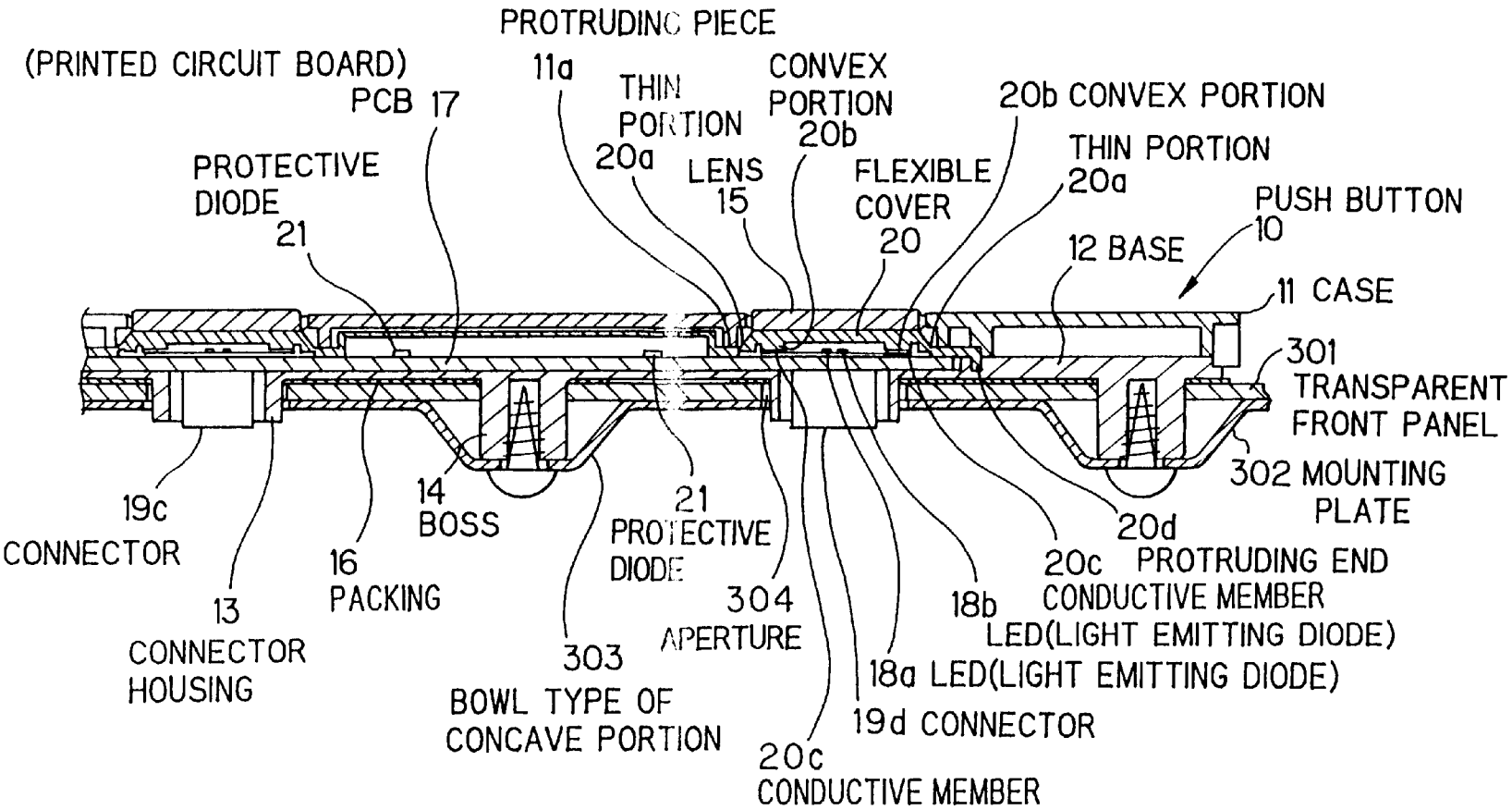
FIG. 7 is a partly diagrammatic sectional view of a push button in a preferred embodiment according to the present invention.
Figure 8:
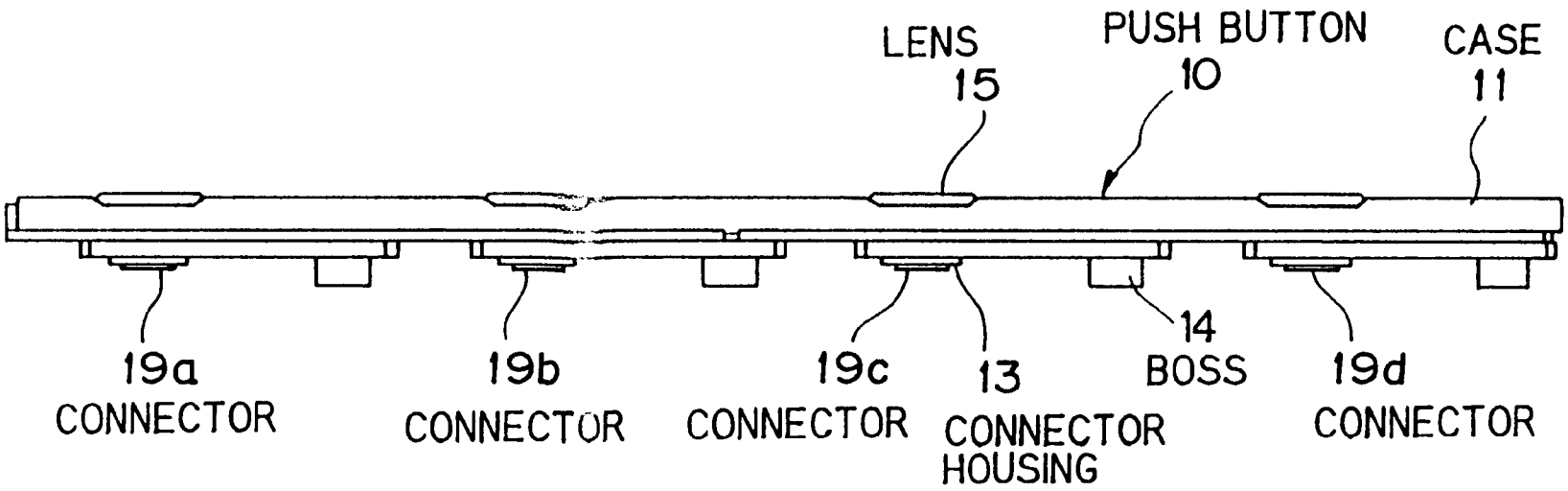
FIG. 8 is a front view of the push button of the present invention as shown in FIG. 7.
Figure 11:
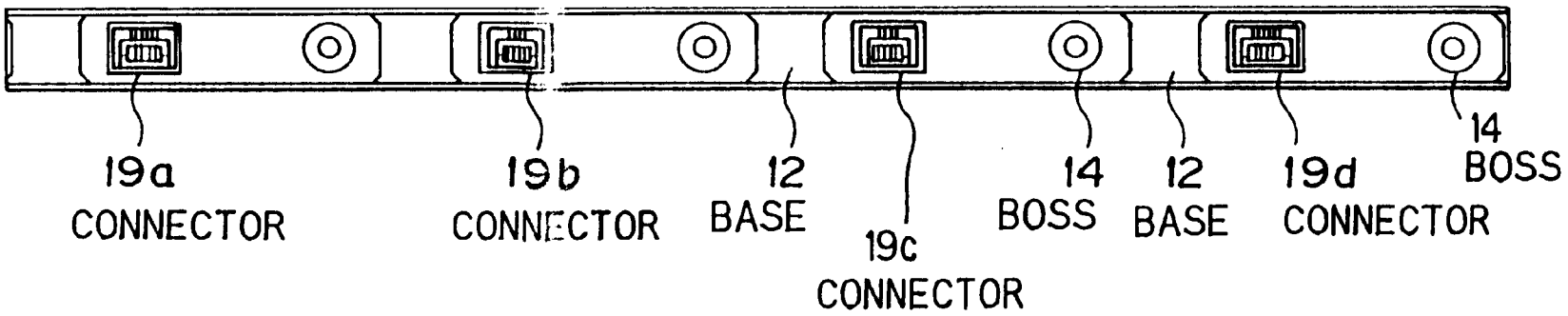
FIG. 11 is a rear view of the push button of the present invention as shown in FIG. 7.

FIG. 1 shows a conventional vending machine using a conventional push button. In FIG. 1, the conventional vending machine 100 comprises a metal panel 101 in its Font, a displaying chamber 103, having a transparent front panel 102, which is arranged at an upper portion of the metal panel 101, and a conventional push button 200 arranged on the transparent front panel 102. The conventional push button 200 has an operating portion in which switches, LEDs (Light Emitting Diodes), letter and symbol plates, and etc. are existed. The LEDs are used to indicate "on sale" and "sold out". Each switch is used to supply a signal of selecting an article to a controller of a CPU (not shown). The conventional push button 200 has also a water-proof space in its inside avoiding water to invade the displaying chamber 103.

A variety of article samples 104 (or printed samples, and etc.) are placed on the upper and lower rows of the displaying chamber 103. An article take out opening 105 is arranged under the displaying chamber 103 of the vending machine 100. A coin unit 106 is also placed beside the displaying chamber 103 of the vending machine 100. The coin unit 106 has a coin-inserting slot 107, a coin-returning and change-receiving slot 108, a lamp 109 indicating no coin for change, etc.

FIGS. 2 to 6 show the conventional push button 200 of FIG. 1. The conventional push button 200 comprises a case 201 which is made from ASA (Acrylonitrile Styrene Acrylate) resin, a base 202 which is combined with the case 201 to form a frame for containing switch parts, and a flexible cover 206 which is placed in the frame to provide a water-proof space. The case 201 has oval openings for a plurality of lenses 203 to be pushed by a customer and to display predetermined symbol and letters. When one of the lenses 203 is pushed by a finger, a switch for selling an article is turned on.

The base 202 has connectors 204 on its back surface. Each of the connectors 204 is connected to the control unit (not shown) of the vending machine 100 (shown in FIG. 1) via a cable (not shown). The base 202 is placed on the transparent font panel 102 (shown in FIG. 1).

The lens 203 is partially exposed through the oval opening formed in the case 201. The lens 203 is in contact with a letter and symbol plate 205, for instance, which is made by a transparent resin sheet, on its inside. Light is transmitted through letter and/or symbol portions of the letter and symbol plate 205, and shielded by the remaining portion of the letter and symbol plate 205. The flexible cover 206 supports the letter and symbol plate 205 on the opposite side of the lens 203. A reflector case which includes conical reflectors 207 having apertures 208 at the bottoms is placed on the inside of the flexible cover 206. The inclined plane of the reflector 207 is processed to have a mirror surface.

A PCB (Printed Circuit Board) 209 on which LEDs 210*a*, 210*b* to radiate the letter and symbol plate 205 through the apertures 208 of the reflectors 207 for indicating "on sale" and "sold out" are mounted is placed on the base 202. The LED 210*a* is for indicating "on sale" and the LED 210*b* is for indicating "sold out". A quantity of light which is supplied to the lens 203 is increased, because the light emitted from the LEDs 210*a*, 210*b* is reflected by the mirror surface of the reflector 207. Switching electrodes 212*a*, 212*b* are also mounted on the PCB 209. Conductive members 213*a*, 213*b* are mounted on the inside of the flexible cover 206 to turn on and off the switching electrodes 212*a*, 212*b* by pushing and releasing the lens 203.

A boss 214 for fixing the push button 200 on the transparent front panel 102 (shown in FIG. 1) is provided on the back surface of the base 202. An aperture into which a screw is inserted is formed in the center of the boss 214. Ring packings 215, 216 for avoiding water to invade into the displaying chamber 103 (shown in FIG. 1) are mounted on roots of the boss 214 and the connector 204.

Each of the lenses 203 is positioned to correspond to each of the article samples 104 (shown in FIG. 1). When coins are inserted into the vending machine 100 (shown in FIG. 1) and there is not an article to be bought in the vending machine 100 (shown in FIG. 1) by a customer, the LED 210*b* for indicating "sold out" is controlled to emit light. The light from the LED 210*b* is transmitted through the letter and symbol plate 205 to be passed through the lens 203. Thus, the customer can know that the article is sold out.

When coins are inserted into the coin-inserting slot 107 of the coin unit 106 of the vending machine 100, the LEDs 210*a* excluding ones corresponding to articles sold out are turned on by the controller (not shown). The lens 203 in accordance with an article which is to be bought is pushed by a customer. The conductive members 213*a*, 213*b* are moved in the direction of the PCB 209 by pushing the lens 203. An electrical circuit (not shown) on the PCB 209 is turned on by connecting the conductive members 213*a*, 213*b* to the switching electrodes 212*a*, 212*b*. Thus, the article to be bought is carried to the article take out opening 105 (shown in FIG. 1) by an article carrier mechanism (not shown) of the vending machine 100 (shown in FIG. 1). When the article has been carried to the article take out opening 105 (shown in FIG. 1), the LEDs 210*a* are simultaneously turned off. When the inserted coins are more than the price of the article to be bought, the change is returned to the coin-returning and change-receiving slot 108 (shown in FIG. 1).

Next, a push button for a vending machine in the preferred embodiment according to the invention will be explained in FIGS. 7 to 14.

FIGS. 7 to 11 show a push button 10 of the present invention. The push button 10 comprises a case 11 which is made from ASA resin, a base 12 which is combined with the case 11 to form a Fame for containing switch parts, and a flexible cover 20 which is placed in the frame to provide a water-proof space. The case 11 has a sectional shape of a semicircle. A plurality of cylindrical connector housings 13 and bosses 14 are positioned with a predetermined interval on the back surface of the base 12. The case 11 has oval openings for a plurality of lenses 15 to be pushed by a customer. The lens 15 is partially exposed trough the oval opening of the case 11. When one of the lenses 15 is pushed by a finger, a switch for selling an article is turned on. When the finger releases the lens 15, the lens 15 returns back to the original position automatically. The letter and symbol plate 205 and the reflector case of the conventional push button 200 (shown in FIG. 2) are not existed on the inside of the lens 15 of the push button 10 of the present invention.

On the other hand, a PCB (Printed Circuit Board) 17 on which LEDs 18*a* for emitting a green color, LEDs 18*b* for emitting a red color, and protective diodes 21 are mounted is placed on the base 12. One LED 18*a* for emitting the green color and one LED 18*b* for emitting the red color are placed to face the lens 15 to radiate the overall surface of the lens 15 through the semi-transparent or transparent flexible cover 20 which is water-proof A variety of indicating modes are available in accordance with a combination with the LEDs 18*a* and 18*b*.

A boss 14 for fixing the push button 10 on the transparent front panel 301 is provided on the back surface of the base 12. An aperture into which a screw is inserted is formed in the center of the boss 14. A packing 16 made from silicon material for avoiding water to invade into the displaying chamber (not shown) is mounted on roots of the boss 14 and the connector housing 13. A mounting plate 302 is mounted on the back surface of the transparent front panel 301. The push button 10 is mounted on the vending machine by the mounting plate 302. The width of the mounting plate 302 is equal to or smaller than that of the push button 10. The mounting plate 302 has a bowl type of a concave portion 303 for placing the boss 14 therein. The mounting plate 302 also has an aperture 304 in which the connector housing 13 is inserted to be exposed in the vending machine.

The PCB 17 is mounted on the base 12. The LED 18*a* for emitting a green or blue color and the LED 18*b* for emitting a red color are mounted on the PCB 17 to correspond to the center of the lens 15, and the protective diodes 21 are mounted on areas of the PCB 17 not to correspond to the lens 15. The length of the PCB 17 is longer than an interval between the connectors 19*c* and 19*d*. The thickness of the push button 10 can be thin, because the LEDs 18*a* and 18*b* are used as a surface-mounted type. Further, parts excluding the LEDs 18*a* and 18*b* are easy to be arranged on the PCB 17, because leads (not shown) are not exposed on the back surface of the PCB 17.

In the connector housings 13, connectors 19*a*, 19*b*, 19*c* and 19*d* are placed on the back surface of the PCB 17. The height of the push button 10 can be low, because a salient portion is not generated on the surface of the PCB 17 by using the plane mounted type of the connectors 19*a* to 19*d*.

The flexible cover 20 which is made from a transparent elastic silicon rubber is arranged on the opposite side of the lens 15. The length of the flexible cover 20 is longer than a distance between the lenses 15 of both sides of the push button 10. The flexible cover 20 is covered above the LEDs 18*a* and 18*b* by each lens 15. Protruding ends 20*d* are formed to be a "L" letter at the both ends of the flexible cover 20. The protruding end 20*d* of the flexible cover 20 is fixed in a groove of the base 12 to provide a water-poof space inside the flexible cover 20. A thin portion 20*a* is formed to provide a function of a flat spring.

A convex portion 20*b* of the flexible cover 20 is formed to face switching electrodes of the PCB 17. A conductive member 20*c* is fixed on the tip (the bottom in FIG. 7) of the convex portion 20*b*. When the lens 15 is pushed by a finger, a conductive member 20*c* of the flexible cover 20 is forced to be contact with a switching electrode (not shown) of the PCB 17 in accordance with the deformation of the thin portion 20*a* of the flexible cover 20.

A protruding piece 11*a* is formed on an inside of the case 11 to surround the lens 15. The flexible cover 20 is compressed at a position near the thin portion 20*a* to form a seal portion by the protruding piece 11*a*.

Figure 12:
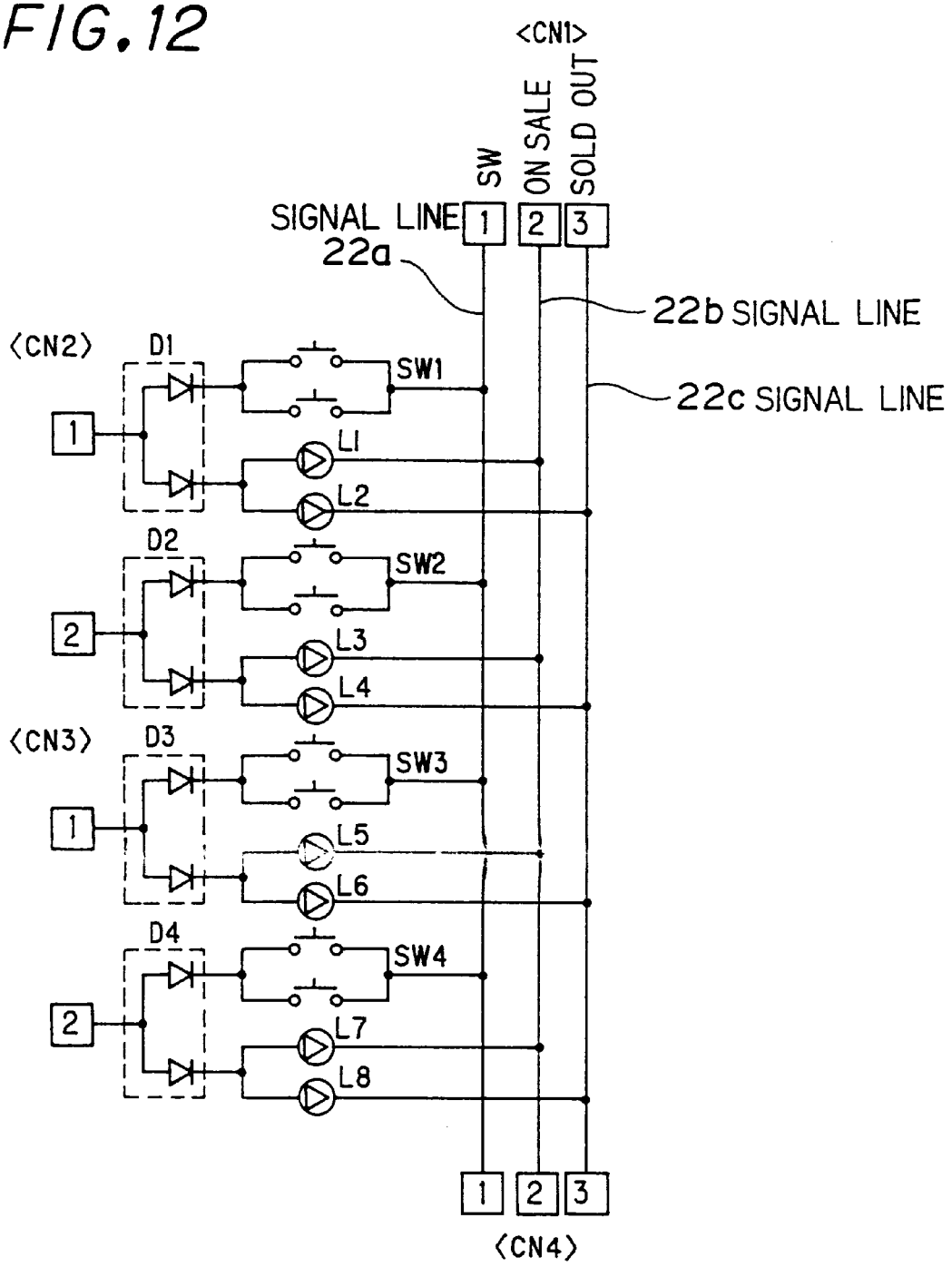
FIG. 12 is a circuit diagram of a connection of connectors and LEDs.

In FIG. 12, it is assumed that the connector 19*a* is a CN1, the connector 19*b* is a CN2, the connector 19*c* is a CN3, and the connector 19*d* is a CN4. Further, it is assumed that L1, L3, L5, and L7 are the LEDs 18*a* for emitting a green color, and L2, L4, L6, and L8 are the LEDs 18*b* for emitting a red color. The diodes 21 are referred as D1 to D4.

The terminals 1 and 2 of the connectors CN2 and CN3 are connected to a power supply of a first voltage, and the terminals 1 of the connectors CN1 and CN4 are at a floating state, while the terminals 2 and 3 of the connectors CN1 and CN4 are connected to the power supply of the first or second voltage dependently on the state of "on sale" or "sold out" by a control circuit (not shown). For instance, if the state is "on sale", the second voltage is applied to the signal line 22*b*, and the first voltage is applied to the signal line 22*c*, so that the LED L1 is turned on in accordance with the difference of the first and second voltages, while the LED L2 is kept to be turned off. Then, if the switch SW1 is pushed by a customer, the first voltage is applied to the signal line 22*a* to be detected by the control circuit, so that an article designated by the switch SW1 is transferred to the article take out opening 105.

FIG. 13 shows a pattern of the indicating modes. In the indicating mode 1, the LED 18*a* for emitting the green color is successively turned on or flickered, and the LED 18*b* for emitting the red color is turned off. Thus, the mode 1 indicates "on sale". On the other hand, in the indicating mode 2, the LED 18*a* for emitting the green color is turned off, and the LED 18*b* for emitting the red color is successively turned on or flickered. Thus, the mode 2 indicates "sold out".

In the push button 10, the LED 18*a* may be a LED for emitting a blue color, and the LED 18*b* may be a LED for emitting an orange or yellow color. In this case, the LED for emitting the blue, orange or yellow color must have an emitting brightness more than a predetermined value, because it is hard to see the light of the lens 15 when the vending machine using the LED for emitting the blues orange or yellow color is placed in the outdoor. Further, an orange color can be seen on the overall suffice of the lens 15 by tog simultaneously the LED 18*a* emitting the green color and the LED 18*b* emitting the red color on. If the orange color is set for a hot article such as coffee drink and the green color is set for a cold article such as juice, it is easy for a customer to choose an article to be bought from the displayed articles.

FIG. 14 shows another pattern of the indicating modes. In the indicating mode 1A, the LEDs 18*a* and 18*b* for emitting the green and red colors are successively turned on or flickered, simultaneously. Thus, the mode 1A indicates "on sale" for hot articles. In the indicating mode 1B, the LED 18*a* for emitting the green color is successively turned on or flickered, and the LED 18*b* for emitting the red color is turned off. Thus, the mode 1B indicates "on sale" for cold articles. On the other hard, in the indicating mode 2, the LED 18*a* for emitting the green color is turned off, and the LED 18*b* for emitting the red color is successively turned on or flickered. Thus, the mode 2 indicates "sold out".

As shown by FIGS. 13 and 14, in the push button 10 for the vending machine, its parts is small in number, and costs is low, because the provision of the letter and symbol plate 205 used in the conventional push button 200 (shown in FIGS. 1 to 6) is not required to indicate "on sale" and "sold out". The lens 15 can be also made small in width and length, because a predetermined indicating area and the quantity of light are not needed for the letters of "sold out". Further, in the push button 10 for the vending machine, its size can be small, because it does not need the reflector 207 used in the conventional push button 200 (shown in FIGS. 1 to 6).

Next operation of the push button 10 will be explained in FIGS. 1, and 7 to 12. Each of the lenses 15 is positioned to correspond to each of the article samples 104 (shown in FIG. 1). When coins ate inserted into the vending machine 100 (shown in FIG. 1) and there is no article to be bought in the vending machine 100 (shown in FIG. 1) by a customer, the LED 18*b* (corresponding to the L2, L4, L6, or L8 in FIG. 12) for emitting a red color is controlled to emit light by a controller (not shown) in the vending machine 100. The light from the LED 18*b* is transmitted through the flexible cover 20 to be passed through the lens 15. Thus, the customer can know that the article is sold out. An indicating effect of the lens 15 is increased, because the overall of the surface of the lens 15 is turned on to be red or green by the diffusion of light When coins are inserted into the vending machine 100 from the coin-inserting slot 107 of the coin unit 106, the LEDs 18*a* for "ON SALE" are tuned on by the controller (not shown). In FIG. 14, the mode 1A indicates "on sale" for cold articles, and the mode 1B indicates "on sale" for hot articles.

If a lens 15 is pushed to designate an article to be bought, by a finger, the conductive members 20*c* are forced to be contact with the switching electrode (not shown) in accordance with the deformation of the thin portion 20*a* of the flexible cover 20, and the switch SW4 (shown in FIG. 12) is turned on. In FIG. 12, an on-signal is sent to the controller (not shown) via the signal line 22*a*. Thus, the article to be bought is carried to the article take out opening 105 (shown in FIG. 1) by an article carrier mechanism of the vending machine 100 (shown in FIG. 1) which is operated by the controller. When the article is carried to the article take out opening 105 (shown in FIG. 1), the LEDs 18*a* for emitting a green color are simultaneously turned off. When the inserted coins are more than the price of the article to be bought, the change is returned to the coin-returning and change-receiving slot 108 (shown in FIG. 1). Thus, one process of the vending machine 100 (shown in FIG. 1) is ended.

When a LED which has a low brightness is used for the vending machine, the push button may have reflectors.

Therefore, in the push button for a vending machine, its size can be small, and its thickness can be thin, because the provision of the letter and symbol plate used in the conventional push button is not required to indicate "on sale" and "sold out". As a result the cost of the push button can be low. A larger number of the push buttons can be provided than that of the conventional push button, because the size of the push button can be small. Further, more kinds of the indicating contents can be increased than that of the conventional push button by indicating the states of "on sale" and "sold out" in accordance with the colors of the LEDs.

As this invention may be embodied in several forms without departing from the spirit of essential characteristics thereof, the present embodiment is therefore illustrative and not restrictive, since the scope of the invention is defined by the appended claims rather than by the description preceeding them, and all changes that fall within meets and bounds of the claims, or equivalence of such meets and bounds are therefore intended to embraced by the claims.

We claim:

1. A push button assembly for a vending machine which indicates "on sale" and "sold out" for articles contained in said vending machine, said push button comprising:

a main body for providing a water-proof space inside thereof, said main body including a transparent or semitransparent portion to transmit a light, and mounted on a surface of a display chamber of said vending machine for displaying article samples; and at least two LEDs (Light Emitting Diodes), each of said LEDs emitting a light of a different color from other, placed on a bottom in said main body, said light emitted from said LED transmitting through said transparent or semitransparent portion;

wherein each of said LEDs is turned on or off to indicate "on sale" or "sold out".

2. The push button assembly for a vending machine, as defined in claim 1, wherein:

said at least two LEDs includes a first LED for emitting a red color and a second LED for emitting a green or blue color;

said second LED, or said first and second LEDs is turned on to indicate said "on sale"; and said first LED is turned on to indicate said "sold out".

3. The push button assembly for a vending machine, as defined in claim 1, wherein:

said at least two LEDs includes a first LED for emitting a red color and a second LED for emitting a green or blue color;

said second LED is turned on to indicate said "on sale"; and said first LED is tuned on to indicate said "sold out".

4. A push button assembly for a vending machine, comprising:

a base made by an insulating material;

a plurality of LEDs (Light Emitting Diodes), each of said LEDs emitting a light of a different color from other;

a PCB (Printed Circuit Board), mounted on said base, for fixing said LEDs on predetermined positions, said PCB including a wiring pattern for a switch circuit;

a connector mounted on a back surface of said PCB;

a flexible cover for covering said LEDs, said flexible cover including a conductive member and transparent portions;

a plurality of lenses, mounted on predetermined positions of said flexible cover, for transmitting a light; and a case, mounted on said base, for exposing a surface of said lens, and covering said flexible cover and said PCB.

5. The push button assembly for a vending machine, as defined in claim 4, wherein:

said plurality of LEDs includes a LED for emitting a red color and a LED for emitting a green or blue color.

6. The push button assembly for a vending machine, as defined in claim 4, wherein:

said plurality of LEDs are of a surface-mounted type.

7. The push button assembly for a vending machine, as defined in claim 4, wherein:

said base includes a sealing material for sealing a periphery of a through-hole of a mounting plate of said vending machine.

* * * * *